United States Patent [19]

Gasparini

[11] Patent Number: 4,948,323

[45] Date of Patent: Aug. 14, 1990

[54] SIDE-LOADING REFUSE COLLECTION WAGON

[75] Inventor: Giorgio Gasparini, Milan, Italy

[73] Assignee: Bergomi S.p.A., Milan, Italy

[21] Appl. No.: 208,473

[22] Filed: Jun. 20, 1988

[30] Foreign Application Priority Data

Jun. 23, 1987 [IT] Italy ..... 21002 A/87

[51] Int. Cl.[5] ..... B65F 3/02

[52] U.S. Cl. ..... 414/408; 414/512; 414/517; 414/513; 414/493; 414/525.6

[58] Field of Search ..... 414/501, 509, 510, 511, 414/512, 513, 514, 515, 516, 517, 518, 492, 493, 406, 407, 408, 409, 525.1, 525.6

[56] References Cited

U.S. PATENT DOCUMENTS

| | | | |
|---|---|---|---|
| 2,557,003 | 6/1951 | Le Laurin | 414/513 |
| 2,912,128 | 11/1959 | Kamin | 414/493 |
| 3,802,585 | 4/1974 | Churchman | 414/512 X |
| 3,815,765 | 6/1974 | Moser et al. | 414/512 |
| 3,865,260 | 2/1975 | Wieschel et al. | 414/517 |
| 3,955,694 | 5/1976 | Herpich | 414/513 |
| 4,310,279 | 1/1982 | Johnston | 414/408 |
| 4,313,707 | 2/1982 | Bingman et al. | 414/409 |
| 4,552,500 | 11/1985 | Ghibaudo et al. | 414/517 X |
| 4,576,540 | 3/1986 | Derain et al. | 414/517 X |

FOREIGN PATENT DOCUMENTS

| | | | |
|---|---|---|---|
| 1217728 | 3/1986 | U.S.S.R. | 414/517 |
| 1248904 | 8/1986 | U.S.S.R. | 414/512 |

*Primary Examiner*—Frank E. Werner

[57] ABSTRACT

A side-loading refuse collection wagon, affording an unusually large load capacity by virtue of optimum utilization of the width limits allowable for the vehicle, includes a chassis, a cab, a body extending along the chassis from the cab. An adequate recess is provided to accomodate a bin hoisting and tilting mechanism and is formed in the right-hand side wall of the body at a body portion from the cab having a shorter length than a major portion having a rectangular cross-sectional shape. A longitudinal guide is affixed to the flat bed of the body, and a hopper complete with refuse material compacting members, which is slidable in said portion of reduced cross-section and has a bottom provided with matching guides is coupled to the guide on the flat bed. A refuse material ejector plate is provided which is movable along the major portion of the body having a rectangular cross-section and rigid with respect to the hopper, as well as a drive mechanism for moving the hopper along the body.

7 Claims, 3 Drawing Sheets

SIDE-LOADING REFUSE COLLECTION WAGON

BACKGROUND OF THE INVENTION

1. Field of the Invention

This invention relates to a side-loading refuse collection wagon of the type which comprises a chassis, a cab, and a body.

2. Description of Related Art

As is known, side-loading wagons are customarily driven to stop alongside a trash bin to be emptied. The bin is picked up from the ground and, by means of a hoisting and tilting device, tipped over into the wagon body or a wagon hopper whence the refuse material is gradually transferred into the wagon body.

In accordance with a prior approach, a side-loading wagon of a currently employed type has, secured on the chassis at an intermediate position between the cab and the body, the hoisting and tilting device, and the hopper is usually laid side-by-side each on a respective lateral side of the wagon. After the body is filled with the refuse material, it is unloaded either by tipping over or by operating an ejector plate. This approach has the drawback of restricting the wagon load capacity due to the limited body length available. In fact, the chassis length is taken up in part by the hopper and the hoisting and tilting device. Another drawback of this approach is that the wagon is liable to let out foul drippings as the refuse material is transferred from the hopper into the body.

Another known approach provides a side-loading wagon wherein the hopper is formed inside the wagon body and movable therein to discharge the refuse material. The hoisting and tilting device is arranged to lie transversely at an intermediate position to the wagon body and the cab, and tips a bin over into the hopper through an opening provided in the body upper region. After the wagon body has been filled, the hopper is driven along the wagon body to eject its cargo. This prior approach has been effective to stop the dripping of foul liquids. However, it still results in an inefficient use of the chassis length, which is partly occupied by the hoisting devices. Further, the hoisting and tilting device is "squeezed" between the wagon body and the cab, being laid across the vehicle axis, which results in a bin picking up and hoisting action which is less direct than that to be obtained with a device laid along the longitudinal axis of the vehicle.

According to a further prior approach, a side-loading wagon is provided wherein the wagon body is extended as far as the cab and the hoisting device tips the bin over to empty through an opening formed in the upper region of the body directly into the wagon body or into a hopper placed within the body.

The latter known approach overcomes the problem of foul liquid dripping, but is still deficient as far as the utilization of the vehicle volume is concerned since the vehicle, which cannot be allowed to exceed the width limits provided for by traffic regulations, can only afford maximum volume capacity if the body is rectangular in shape with the base dimension equal to the maximum allowable width. Any other forms are bound to tax the volume of the vehicle.

In view of the fact that both the ejector plate and the front wall of any hopper accommodated within the body are to have the same cross-section as the wagon body interior in order to discharge the refuse material by a sliding movement spanning the full length of the wagon body, the prior approaches have adopted wagon bodies of reduced width throughout or having cross-sectional shapes other than a rectangle, in order to contain the bin hoisting and tilting device within the maximum width limits allowed for the vehicle, to the evident detriment of the maximum volume capacity that the vehicle design could otherwise afford.

SUMMARY OF THE INVENTION

The problem underlying this invention is to provide a wagon of the type specified above with such constructional and operational features as to overcome the above-noted drawbacks.

This problem is solved by a wagon.

BRIEF DESCRIPTION OF THE DRAWINGS

Further features and the advantages of a wagon according to the invention will become apparent from the following detailed description of a preferred embodiment thereof, to be taken by way of example and not of limitation in conjunction with the accompanying drawings, where.

DETAILED DESCRIPTION OF PREFERRED EMBODIMENTS

Figure 1:
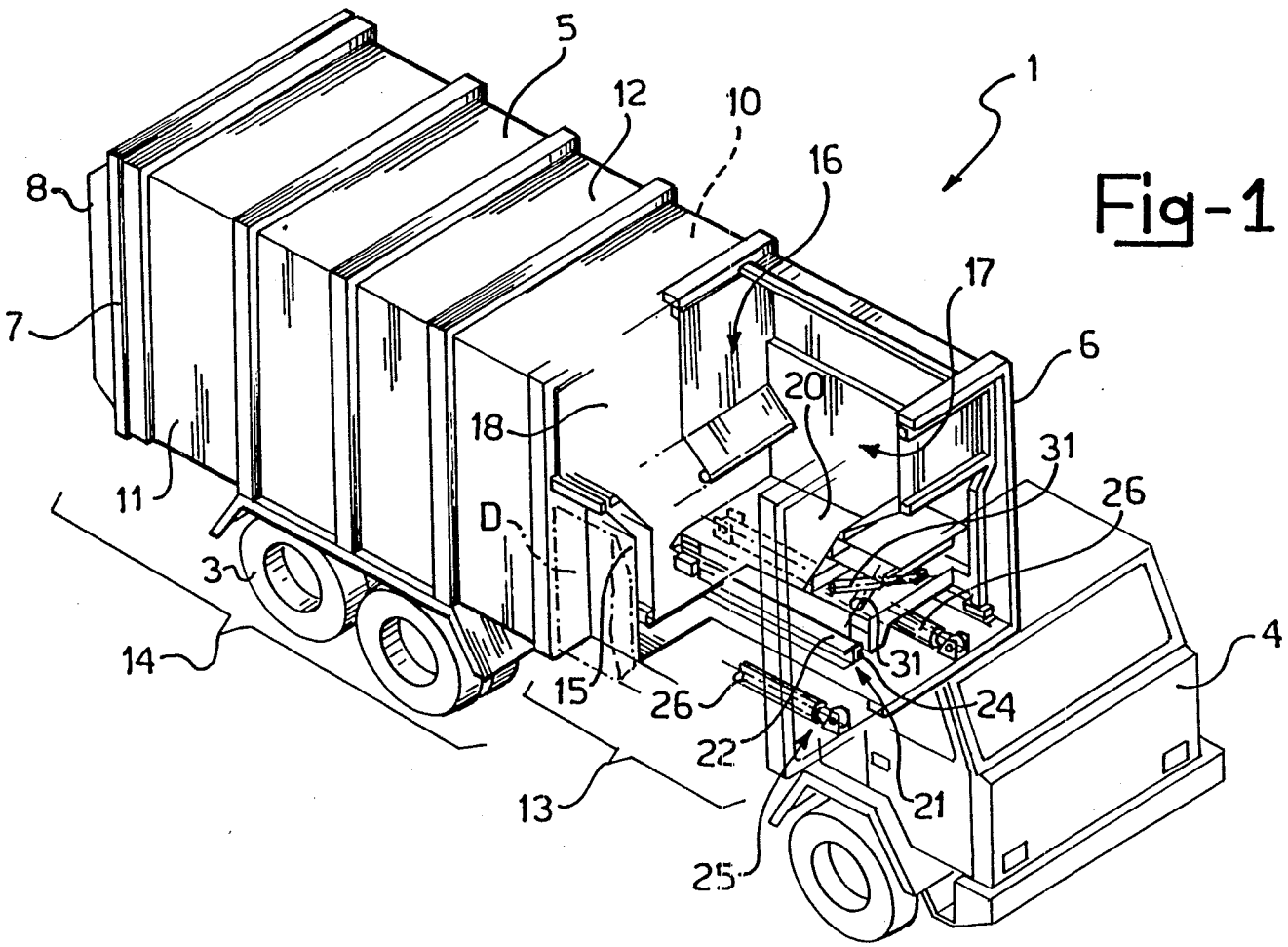
FIG. 1 is a part-sectional perspective view of a wagon according to the invention.
Figure 2:
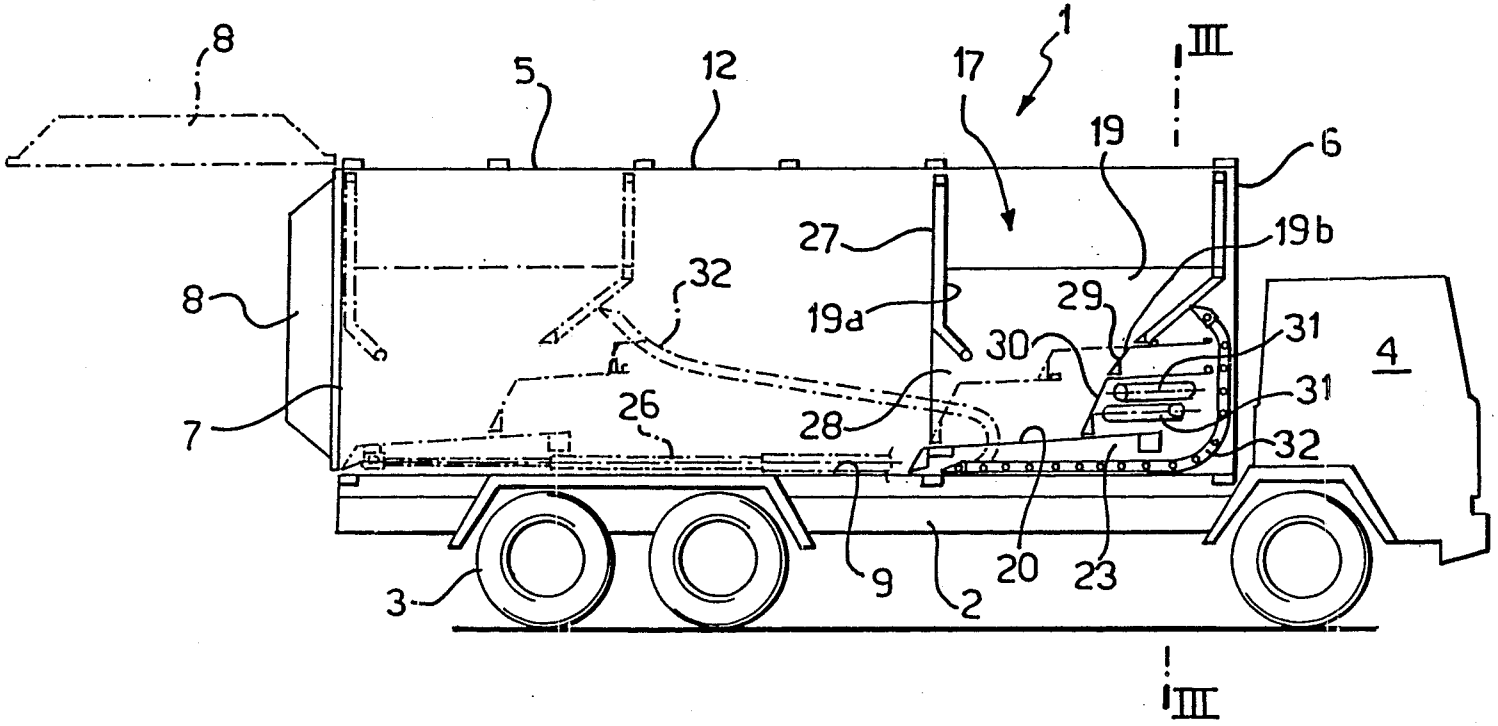
FIG. 2 is a side view showing partly in phantom lines the wagon of FIG. 1.
Figure 3:
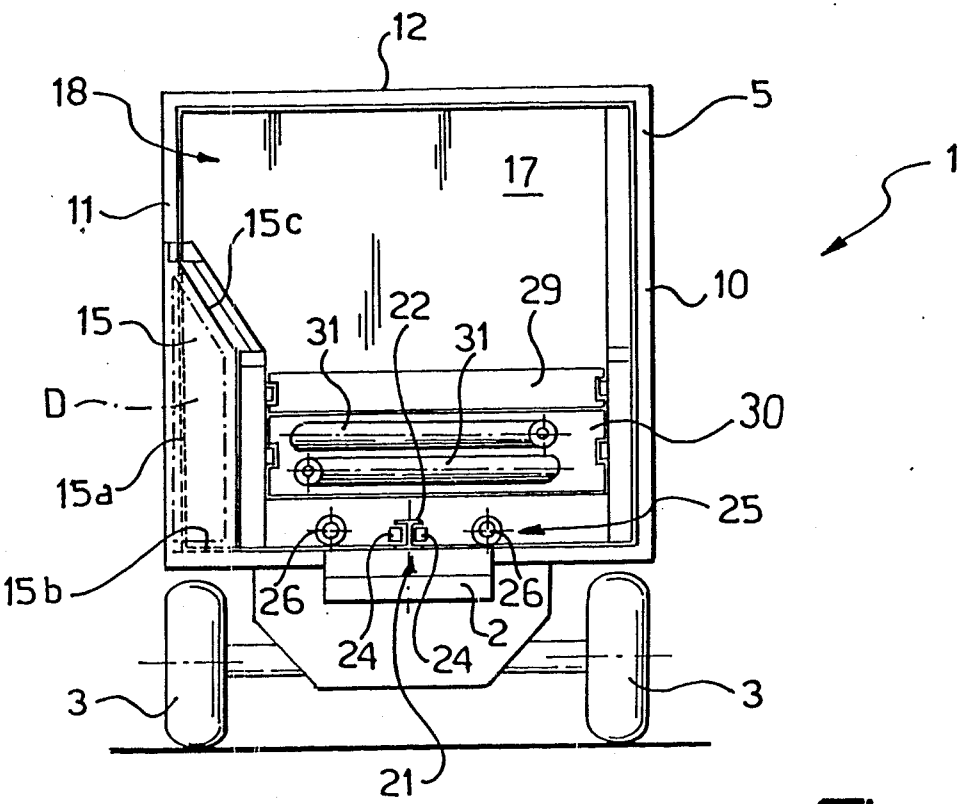
FIG. 3 is a sectional view taken through the wagon of FIG. 1 along the line III—III.

With reference to the drawing views, the numeral 1 denotes generally a side-loading refuse collection wagon.

The wagon 1 comprises a chassis 2 extending along a longitudinal axis X—X and being mounted on wheels 3. Mounted on the chassis 2 are a driver's cab 4 and a wagon body 5 intended to receive the refuse material therein. The wagon body 5 lies along the chassis 2 behind the cab 4. Stated otherwise, the body 5 has a forward end 6 set close against the cab 4. An opposite, rearward end 7 thereof is provided with a gate 8 which can be opened to unload the wagon cargo.

The wagon body 5 has a flat bed 9, a left-hand side wall 10, a right-hand side wall 11, and a top wall or ceiling 12.

In the wagon 1 of this invention, the body 5 has a portion 13 of reduced cross-sectional area with respect to a major portion 14 which has a rectangular cross-section equal to the largest cross-section allowable by the width limitations of the wagon.

In particular, the reduced cross-sectional portion 13 defines in the right side wall 11 a lateral recess 15 sized to accommodate a conventional bin hoisting and tilting mechanism D, also conventional in design and not shown.

The cross-sectional shape of the recess 15 is a right trapezoid having a major base **15*a*, a right-angle side 15*b*, and an oblique side 15*c*. The major base 15*a* spans most of the height of the body wall 11 from the flat bed 9, and the right-angle side 15*b* occupies but a short portion of the bed 9**.

The wall 11 and wall 12 are open across the remaining portion and the portion 13, respectively, to define a refuse material inlet 16.

The wagon 1 further comprises a hopper 17, which is dimensioned to fit in the body portion 13 of reduced cross-section and has a top inlet 18 dimensioned to substantially mate with the inlet 16. The hopper 17 has side walls 19 and a bottom 20.

The hopper 17 is arranged to be slidable along the body 5 in a manner to be described.

The wagon body 5 is provided with a longitudinally extending guide 21 embodied by a rail 22 affixed to the bed 9 along its longitudinal centerline.

The bottom 20 of the hopper is held off the bed 9 to define a space 23 therebetween. The bottom 20 of the hopper is provided with matched guide means 24 coupled to the rail 22, such as the shoes shown in this example.

To drive the hopper along the body 5, a drive means 25 is provided which advantageously comprises a pair of identical hydraulic cylinders, indicated at 26, accommodated within the space 23 and extending longitudinally therein, with one hydraulic cylinder on one side and the other hydraulic cylinder on the other side of the rail 22 symmetrically thereto.

The wagon 1 of this invention also comprises a refuse material ejector plate 27 which is movable along the major portion 14 of the body 5. The plate 27 is unitary with the hopper 17 and can be driven therewith toward and away from the rear end 7 of the wagon body.

A portion of the plate 27 is shared by a portion **19*a* of the hopper side wall 19 and formed with an opening 28**, through which the refuse material is transferred from the hopper into the wagon body past the ejector plate.

For this purpose, an opposite portion **19*b* of the hopper side wall 19 is made movable and embodied by two pusher segments 29 and 30, which are coupled telescopically and constitute compacting members. The segment pair 29, 30 can be driven, as by a pair of hydraulic cylinders 31 laid with their axes in an X-like configuration, from a retracted position to an extended position at which they will substantially block the opening 28**.

A roll-up chain 32, of a type commonly referred to as a "cable carrier", extends between the bed 9 and the hopper 17 to provide support for the oil supply hoses to the cylinders 31. This chain is housed within the space 23 with the hopper positioned at the portion 13 of reduced cross-section.

The operation of the wagon 1 according to the invention will be next described with reference to a starting condition as shown in FIG. 1, where the hopper 17 is positioned at the portion 31 of the wagon body and the pusher segments 29 and 30 are in their retracted condition.

As refuse material is being loaded, through the body inlet 16, into the hopper 17, it is passed into the body past the plate 27 through the opening 28, by the action of the segments 29 and 30 which are driven repetitively toward the opening 28 by the cylinders 31.

With the wagon body filled with refuse material, the latter will be ejected through the open end 7 of the wagon body by the plate 27 being driven, along with the hopper 17, by the cylinder pair 26 toward the open end 7.

A major advantage of the wagon according to this invention resides in an increased refuse load capacity. In fact, its body has for most of its length a cross-section equal to the allowable maximum, and for a short portion thereof a recess with a trapezoidal cross-section of minimal volume.

A further advantage of the inventive wagon resides in the increased breadth of the hopper, as afforded by the space left between its bottom and the flat bed to accommodate the hopper driving cylinders in their home positions.

Another advantage of the wagon according to the invention is that it affords improved tilting of a bin as it is presented to the hopper inlet for emptying of its refuse contents. In fact, the right side wall 11, which is open at the top, and the oblique side **15*c*** of the right trapezoid cross-section jointly contribute to improved access for the bin and enhanced ability to open the bin bottom gate.

Understandably, the wagon disclosed hereinabove may be altered and modified in many ways by a person skilled in the art in order to meet specific contingent demands, without departing from the true scope of the invention as set forth in the appended claims.

I claim:

1. A side-loading refuse collection wagon comprising:

a chassis;

a cab;

a body, said body extending along the chassis behind the cab in a longitudinal direction and having a flat bed portion;

a longitudinally extending guide rail fixed to the flat bed;

a hopper movably mounted on said guide rail;

said body having a first portion of rectangular cross-section in a plane perpendicular to said longitudinal direction and a second portion wherein a reduced cross-section is produced by a recess in a side of said body; and a bin hoisting and tilting mechanism mounted in the recess, said recess having a right trapezoidal cross-sectional shape in a plane perpendicular to said longitudinal direction with a right angle side occupying a short portion of the flat bed and an oblique side located below an inlet opening through which the refuse from the bin is deposited into said hopper, whereby across to said hopper is improved.

2. A wagon according to claim 1, wherein said hopper is a funnelled hopper for receiving repeated small amounts of refuse and being slidably arranged along said portion of reduced cross-section from the front to the rear of said body, and an ejector plate for compacting the refuse released from said hopper toward the rear of said body, the refuse material being movable along the longitudinal direction of the body, said plate and said hopper being of a unitary construction wherein said ejector plate is also a rear wall of said hopper.

3. A wagon according to claim 2, wherein said hopper includes a bottom provided with matching guide means coupled to said longitudinally extending guide rail on the flat bed for moving said hopper along the flat bed, and further including drive means for moving said hopper along the flat bed.

4. A wagon according to claim 3, wherein the bottom of the hopper is spaced apart from the flat bed for accommodating said drive means between the flat bed and the bottom of said hopper.

5. A wagon according to claim 4, wherein said longitudinally extending guide rail extends along the longitudinal axis of the flat bed.

6. A wagon according to claim 5, wherein said drive means includes two hydraulic cylinders extending longitudinally on opposed sides of the rail.

7. A wagon according to claim 6, wherein said hopper includes compacting members supplied on a cable carrier chain housed between the flat bed and the bottom of the hopper, said compacting members being provided at the base of said hopper to expel refuse from the hopper into said body.

* * * * *